US005894959A

United States Patent [19]

Sigurlidason

[11] Patent Number: 5,894,959

[45] Date of Patent: Apr. 20, 1999

[54] VISCOUS SUBSTANCE DISPENSING KNIFE

[76] Inventor: Sigurdur Ragnar Sigurlidason, 1855 Hyde St., San Francisco, Calif. 94109

[21] Appl. No.: 08/971,379

[22] Filed: Nov. 17, 1997

[51] Int. Cl.[6] ..... B65B 1/04

[52] U.S. Cl. ..... 222/192; 401/266; 401/139

[58] Field of Search ..... 401/266, 139, 401/137, 138; 30/123.3, 136; 222/192

[56] References Cited

U.S. PATENT DOCUMENTS

| | | | |
|---|---|---|---|
| 878,524 | 2/1908 | Gregory | 30/136 |
| 2,772,432 | 12/1956 | Andreola | 401/139 |
| 2,832,086 | 4/1958 | Wells | 401/139 |
| 3,088,470 | 5/1963 | Hall | 401/266 |
| 3,536,411 | 10/1970 | Eisert | 401/266 |
| 4,011,879 | 3/1977 | Roberts | 401/266 |

*Primary Examiner*—Steven O. Douglas

[57] ABSTRACT

A spreading knife, comprising a main blade housing and a blade cover. The main blade housing has a reservoir for holding a viscous substance, such as condiment. A filling cap is located fully proximally on the spreading knife and is selectively removable for filling the reservoir. A main passageway extends distally from the reservoir, and is in fluid communication with the reservoir. A plurality of vertical passageways extend from the main passageway, each having a vertical passageway end. A blade cover has a flat spreading surface, pressurizes the main passageway and vertical passageways, and has dispensing openings in the flat spreading surface which correspond to the vertical passageway ends. A pump is operable to force air into the reservoir, and cause the substance to be dispensed through the dispensing openings onto the flat spreading surface to spread the condiment onto a bread surface.

5 Claims, 3 Drawing Sheets

VISCOUS SUBSTANCE DISPENSING KNIFE

BACKGROUND OF THE INVENTION

The invention relates to a viscous substance dispensing knife. More particularly, the invention relates to a knife having an internal reservoir capable of holding butter or any other viscous condiment, and then dispensing the condiment so that it may be easily spread onto a surface.

Many people enjoy some sort of condiment on their bread, toast, bagels, and muffins. This condiment is typically contained in a jar, but is removed from the jar and spread with a knife. However, one must typically move the knife between the jar and the bread several times, to first carry the condiment over to the bread, and then spread it across the bread surface.

When traveling, every additional item brought along must be carried throughout the trip. Especially when camping or hiking, extraneous articles create considerable additional difficulty. In the case of condiments, it is probably unnecessary to carry an entire jar, especially when perhaps only one twentieth of its contents will be used during the trip.

U.S. Pat. No. 5,288,274 to Bell et al discloses a knife which contains a reservoir for holding "fake blood". Bell et al. is designed to release the blood on impact, for novelty purposes.

While these units may be suitable for the particular purpose employed, or for general use, they would not be as suitable for the purposes of the present invention as disclosed hereafter.

SUMMARY OF THE INVENTION

It is an object of the invention to produce a knife capable of holding a viscous substance such as a condiment, and then dispensing the substance when desired.

It is another object of the invention to provide a condiment dispensing knife that is lightweight, and self contained to make it suitable for travel, camping, and hiking.

It is a further object of the invention to provide a knife wherein the condiment is dispensed in a location where it is to be used. In particular, a flat spreading surface is provided with a plurality of dispensing openings. The condiment is dispensed onto the flat spreading surface, for allowing the condiment to be instantly spread on a bread surface as it is being dispensed.

It is a still further object of the invention that the invention employs a bare minimum of moving parts, and that the condiment substances do not come into contact with the moving parts. This simplistic design simplifies cleaning, reduces the chance of clogging, and allows more viscous condiment substances to be used with the invention.

The invention is a spreading knife, comprising a main blade housing and a blade cover. The main blade housing has a reservoir for holding a viscous substance, such as condiment. A filling cap is located fully proximally on the spreading knife and is selectively removable for filling the reservoir. A main passageway extends distally from the reservoir, and is in fluid communication with the reservoir. A plurality of vertical passageways extend from the main passageway, each having a vertical passageway end. A blade cover has a flat spreading surface, pressurizes the main passageway and vertical passageways, and has dispensing openings in the flat spreading surface which correspond to the vertical passageway ends. A pump is operable to force air into the reservoir, and cause the substance to be dispensed through the dispensing openings onto the flat spreading surface to spread the condiment onto a bread surface.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
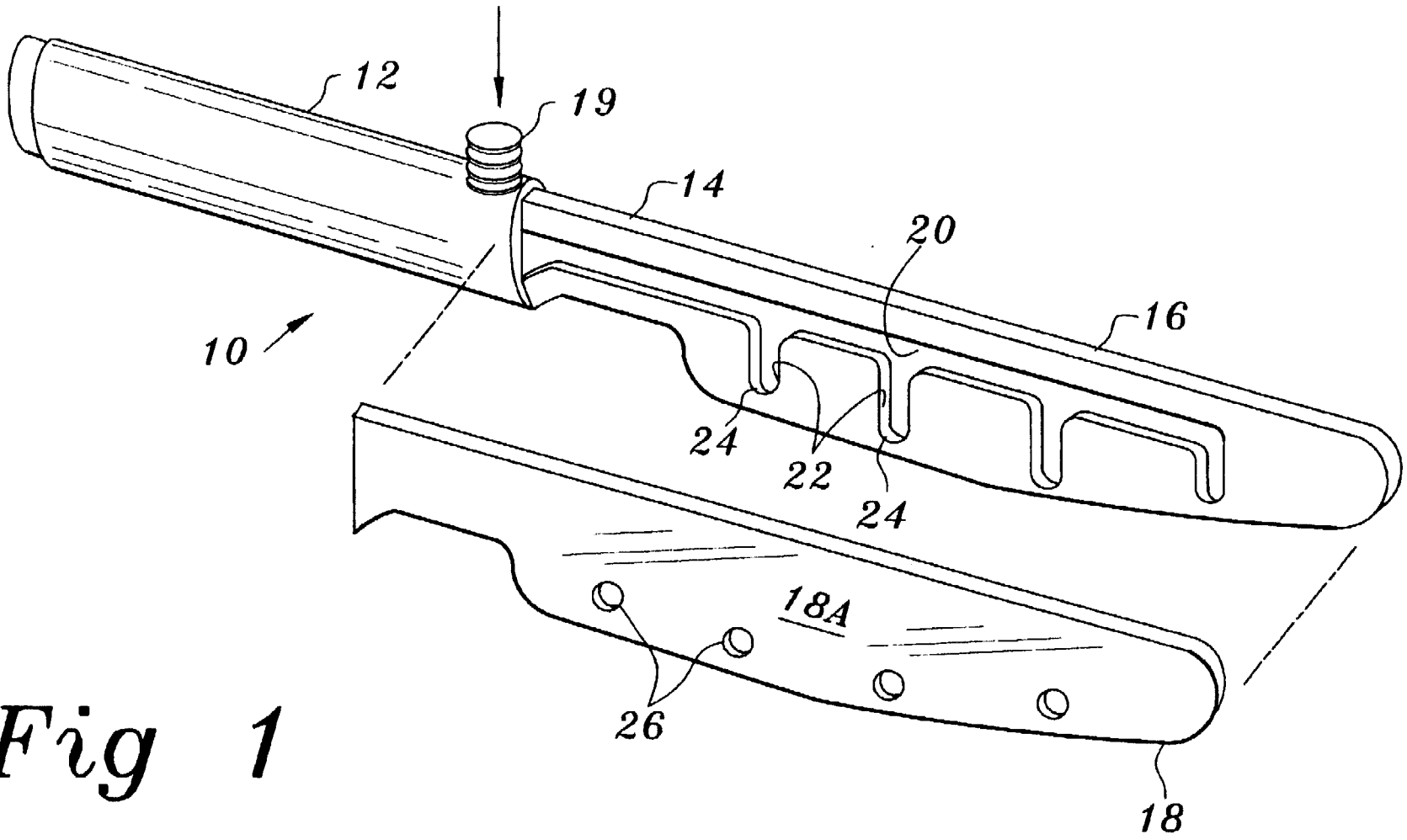
FIG. 1 is an assembly view, illustrating the invention wherein a portion of the blade has been removed.

FIG. 1 illustrates a spreading knife 10 comprising a handle 12 and a blade 14. The blade comprises a main blade housing 16 and a blade cover 18 having a flat spreading surface 18A. A dispensing means according to a preferred embodiment of the invention includes a bellows-type air pump 19 which is located on the handle 12. As illustrated in FIG. 1, the main blade housing 16 comprises a main passageway 20 extending horizontally and distally along the main blade housing 16 and a plurality of vertical passageways 22. Each of the vertical passageways 22 has a vertical passageway end 24 opposite the main passageway 20.

The blade cover 18 is shaped to match the main blade 16 so that the main passageway 20 and vertical passageways are covered and pressurized. However, the blade cover 18 has a plurality of dispensing openings 26 in the flat spreading surface 18A, each dispensing opening corresponds to one of the vertical passageway ends 24. The blade cover 18 does not require a sharpened edge, since the primary purpose of the spreading knife 10 is spreading, and not cutting, slicing, or chopping. Thus, the particular material chosen for making the various components of the spreading knife 10 is not crucial. Preferably, however a lightweight plastic should be used for the majority of the components, in keeping with the goal of producing a lightweight device suitable for travel, camping, and hiking.

Figure 2:
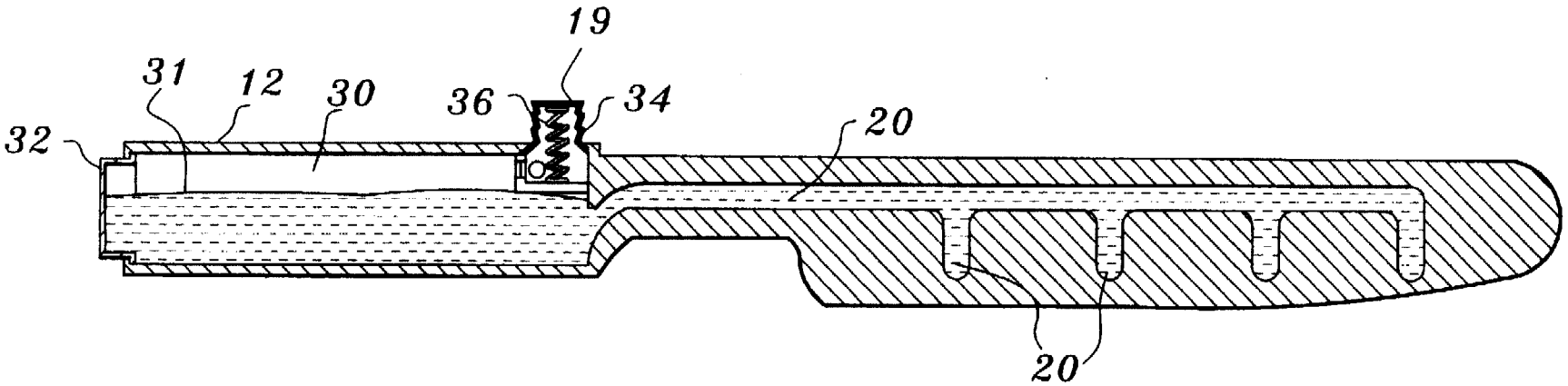
FIG. 2 is a cross sectional view, illustrating internals details of the invention.

FIG. 2 is a cross sectional view, which illustrates internal details of the spreading knife 10. In particular, the main blade housing 16 extends through the handle 12, and includes a main reservoir 30. The reservoir is in fluid communication with the main passageway 20. A filling cap 32 is located fully proximally on the spreading knife 10, and is in fluid communication with the reservoir 30. The filling cap 32 is selectively removable to fill the reservoir 30 with a condiment substance 31 such as viscous butter, jelly, mayonnaise, peanut butter, etc. In addition, the condiment substance 31 may be any other viscous substance. The filling cap 32 is normally sealed to maintain pressurization within the reservoir 30.

The pump 19 as illustrated herein by example, is a one-way air pump, which is operable to force air into the reservoir 30, but does not allow air or any viscous material contained in the reservoir to escape. The pump 19 comprises a bellows 34 and a spring 36. When the bellows 34 is compressed, it forces air into the reservoir, and compresses the spring 36. When the bellows 34 is released the spring 36 decompresses the bellows 34 and air rushes into the bellows 34.

As air is forced into the reservoir 30, pressure is exerted upon the condiment substance, urging it to escape through any opening. The only opening provided however are the dispensing openings 26 at the vertical passageway ends 24. It is important to note that according to the preferred embodiment, no moving parts are in direct contact with the condiment substance 31. No piston is used to urge the condiment out of the knife 10. Thus, clogging and jamming is eliminated, and cleaning is simplified.

Although variations are possible for the dispensing means, an important feature of the pump is that it exerts pressure upon the condiment substance. An additional suitable pumping device would include a one way moving sealant, or piston. The piston is advanced by pressurization provided by a pumping device. The use of an advancing piston interposed between the pump and the viscous substance regulates the dispensing, and provides for a more uniform dispensing of the substance.

Figure 3:
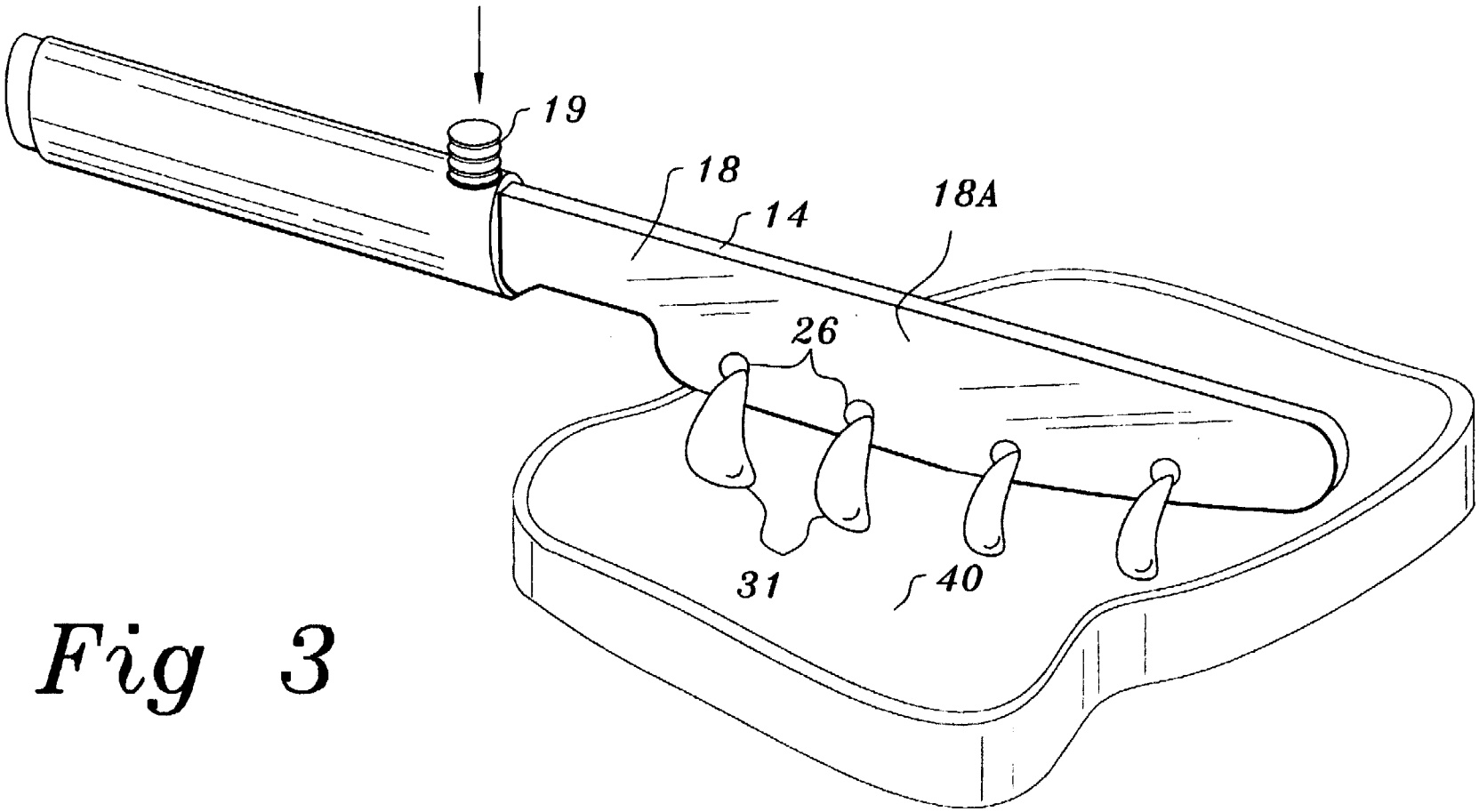
FIG. 3 is a diagrammatic perspective view, illustrating the invention in use, dispensing a condiment, and spreading it onto a piece of bread.

Referring to FIG. 3, the blade 14 is being used to spread a condiment substance 31 on a bread surface 40. The bread surface 40 may be toasted or untoasted bread, a muffin, cracker, or in general any surface upon which a condiment type substance is desired. The pump 19 is being operated 19 to force air into the reservoir, and thereby force the condiment substance 31 out of the dispensing openings 26. Once the condiment substance 31 leaves the dispensing openings 26, it is in the perfect location—on the flat spreading surface 18A of the blade cover 18—for spreading onto the bread surface 40.

In conclusion, herein is presented a knife, having an internal reservoir for holding a viscous substance, such as a condiment. When desired, the condiment is dispensed from the knife through a plurality of dispensing openings onto a flat spreading surface. Once on the spreading surface, the condiment may be spread onto a bread surface by using the flat spreading surface.

What is claimed is:

1. A spreading knife, for holding, dispensing, and spreading a viscous substance, comprising:

a main blade housing, having a reservoir for holding the substance and a main passageway in communication with the reservoir;

a blade cover having a flat spreading surface, the blade cover sealing the main passageway and having dispensing openings on the flat spreading surface in communication with the main passageway; and a dispensing means for forcing the substance out of the dispensing openings, comprising an air pump, for forcing air into the reservoir, thereby forcing the substance out through the dispensing openings.

2. The spreading knife as recited in claim 1, wherein the main blade housing further comprises vertical passageways in communication with the main passageway, each vertical passageway having a vertical passageway end that is opposite the main passageway; and wherein each of the dispensing openings are located at one of the vertical passageway ends.

3. The spreading knife as recited in claim 2, further comprising a filling cap that is selectively removable for filling the reservoir with the substance, and is normally sealed to retain pressurization within the reservoir.

4. The spreading knife as recited in claim 3, wherein the filling cap is located fully proximally on the spreading knife.

5. The spreading knife as recited in claim 4, wherein the pump comprises a bellows and a spring, the bellows is compressed to force air into the reservoir and compress the spring, when the bellows is released the spring decompresses the bellows and causes air to enter the bellows.

* * * * *